United States Patent [19]

Novinski et al.

[11] 4,370,367

[45] Jan. 25, 1983

[54] SELF-BONDING FLAME SPRAY WIRE FOR PRODUCING A READILY GRINDABLE COATING

[75] Inventors: Edward R. Novinski, Mineola; John H. Harrington, Warick, both of N.Y.

[73] Assignee: Metco Inc., Westbury, N.Y.

[21] Appl. No.: 233,804

[22] Filed: Feb. 12, 1981

Related U.S. Application Data

[62] Division of Ser. No. 936,169, Aug. 23, 1979, Pat. No. 4,276,353.

[51] Int. Cl.[3] ..... B32B 15/16

[52] U.S. Cl. ..... 427/423; 428/558; 75/0.5 R; 75/252; 75/255; 75/25

[58] Field of Search ..... 427/423; 428/558, 651; 75/0.5, 252, 255

[56] References Cited

U.S. PATENT DOCUMENTS

| | | | |
|---|---|---|---|
| 3,322,515 | 5/1967 | Dittrich et al. | 149/5 |
| 4,039,318 | 8/1977 | Patel | 427/423 |
| 4,190,442 | 2/1980 | Patel | 427/423 X |
| 4,191,565 | 3/1980 | Patel | 427/423 X |

*Primary Examiner*—G. O. Peters

*Attorney, Agent, or Firm*—S. A. Giarratana; E. T. Grimes; J. D. Crane

[57] ABSTRACT

A self-bonding flame spray wire capable of forming a readily grindable coating formed of a sheath of aluminum and a compacted powder core containing a major portion of nickel and stainless steel and a minor portion of aluminum and metal oxide. The core may contain from about 10 to 90 percent, and preferably about 61 percent, by weight nickel, about 10 to 90, and preferably 30, percent by weight stainless steel, from 1 to 10 percent by weight, and preferably 5 percent by weight, aluminum, from ¼ to 10 percent by weight, and preferably 4 percent by weight, of the metal oxide which may, for example, be cobalt oxide or zirconium oxide, and is most preferably zirconium oxide.

9 Claims, No Drawings

SELF-BONDING FLAME SPRAY WIRE FOR PRODUCING A READILY GRINDABLE COATING

This is a division of application Ser. No. 936,169, filed Aug. 23, 1978, now U.S. Pat. No. 4,276,353.

This invention relates to a self-bonding flame spray wire capable of forming a readily grindable coating.

Flame spray materials which are capable of bonding to a clean surface without special surface preparation are referred to in the art as self-bonding flame spray materials. A self-bonding flame spray wire formed of a sheath of aluminum and a compacted powder core containing a major portion of nickel powder and a minor portion of aluminum powder is described in U.S. Pat. No. 3,322,515. This wire has found wide acceptance in commerical use as an initial bonding coat in order to adhere other spray materials, such as steels, which are to be ground or machined to provide a bearing surface for repairing machinery parts, and particularly shafts. The wire itself is not generally suitable for spraying an acceptable final coat which is to be ground, as the same did not grind or finish well.

One object of this invention is to improve the above-mentioned aluminum sheath/compacted nickel-aluminum powder core wire, so that the same, when sprayed, will produce a readily grindable coating without loss of its other desired characteristics.

This and still further objects will become apparent from the following description.

In accordance with the invention, we have discovered that the aluminum sheath/compacted aluminum-nickel powder core as described in U.S. Pat. No. 3,322,515 may be improved so that the same will form a readily grindable coating without loss of its bonding or other desirable characteristics, if the compacted powder core additionally contains, based on the total metal content of the core, from about 10 to 90, and preferably about 30, percent by weight of stainless steel, about ¼ to 10, and preferably 4, percent by weight of metal oxide, such as cobalt oxide or zirconium oxide, and preferably zirconium oxide.

The stainless steel may be any of the known iron base alloys containing at least one alloying element to provide passivity to oxidation and corrosion. Examples are conventional stainless steels containing at least 12 percent chronium, needed for passivity, but less than 30 percent, which are either martensitic, austenitic or ferritic. Another type of stainless steel contains aluminum and manganese passifying agents. A 431-type stainless steel has been found preferable.

In all other respects, the wire is as described in U.S. Pat. No. 3,322,515 and should contain from about 1 to 10 percent, and preferably about 5 percent, aluminum powder in the core, and from about 10 to 90 percent by weight, and preferably about 61 percent by weight nickel in the core.

The wire is formed by initially forming a tube or hollow wire of aluminum, which is preferably oversized by an amount between 200 percent and 600 percent of the final wire diameter, which should correspond to standard diameters used in flame spraying. The weight percent of aluminum in the wire may amount to between 5 to 35 percent, and preferably about 23 percent of the total metal in the sheath and core.

The powder mixture of the nickel, aluminum, stainless steel and metal oxide are blended together and then preferably pressed into cylindrical briquettes in a conventional die. It has been found that with the powder mixture used in accordance with the invention, the previously required higher pressures for forming the briquettes are not necessary. Thus, for example, die pressures of about 1,000 pounds per square inch, as for example, about 1,300 to 1,600 pounds per square inch, were required to compact the aluminum-nickel briquettes, whereas die pressures of less than 1,000 pounds per square inch, as for example 800 pounds per square inch, are only required to form the briquettes in accordance with the invention.

The nickel powder may have a size ranging between ½ and 200 microns, and preferably between 3 and 7 microns, the stainless steel may have a size between about 10 and 200 microns, and preferably between 30 and 125 microns, the aluminum may have a size between 0.5 and 200 microns, and preferably between 5 and 10 microns, and the metal oxide, such as the zirconium oxide, may have a size between 0.5 and 40 microns, and preferably from 1 to 8.0 microns.

The powder is preferably briquetted into the form of cylindrical briquettes of from ¼ to 1 inch length and of a diameter which will slide easily into the aluminum sheath. The sheath is then filled with these briquettes, the ends of the sheath sealed, as for example, by welding, and the sheath swaged to the final wire diameter. Thereafter, the formed wire is annealed to facilitate handling and passage through the spray gun. Annealing temperatures between about 300° and 700° F., averaging 600° F., have been found preferable, as at lower temperatures, insufficient ductility is produced, and at higher temperatures, blistering of the wire surface may occur.

The wire in accordance with the invention, as mentioned, should have the conventional sizes for flame spray wires and should be produced with the accuracy tolerances conventional for flame spray wires. Thus, for example, the wires may have a size between about ¼ inch and 20 gauge, and are preferably of the following sizes: 1/16"+0.0005" to −0.0025", ⅛"+0.0005" to −0.0025", 11 gauge +0.0005" to −0.0025", and 15 gauge +0.001". The wire should be formed with a smooth, clean finish free from surface marks, blemishes or defects, as is conventional in the flame spray art.

The wires are sprayed in the conventional manner, using conventional wire-type flame spray guns, as for example, is described in U.S. Pat. No. 3,322,515.

Upon spraying, the wires will bond with a high surface bond to a clean surface which haas no special surface preparation; but to increase the bond, the surface may be initially treated with any bonding preparation known or conventional in the flame spray art, as for example, grit-blasting or rough-thread turning.

The coating formed with wires in accordance with the invention, upon spraying, have a bond strength of above 3,000 psi, up to above 4,000 psi, have a good coating hardness, good resistance to abrasion wear, show satisfactory coefficient of friction, and as constrasted to the prior known aluminum sheath/compacted nickel-aluminum powder core wires, produce coatings which show excellent grinding characteristics and which may, for example, be ground to provide bearing surfaces of excellent ground surface finish characteristics.

The following examples are given by way of illustration and not limitation.

EXAMPLE 1

A powder mixture containing 61 percent by weight of nickel of a particle size between about 3 and 7 microns, 30 percent by weight of 431 stainless steel of a particle size between about 30 and 100 microns, 5 percent by weight of aluminum of a particle size between about 5 and 10 microns, and 4 percent by weight of zirconium oxide of a particle size between 1 and 8 microns, was thoroughly blended and pressed together in the form of cylindrical briquettes, using a die pressure of 800 psi. The cylindrical briquettes formed had a diameter of 0.414" and a length of 0.7". The briquettes were loaded into a drawn aluminum tube of 13 foot length, having a 0.422" inner diameter and a 0.041" wall thickness. The ends of the tube were plugged closed and the tube then swaged to a final diameter of ⅛"+0.005" to −0.005", the surface being maintained free of dents, gouges, scratches and other marks. The wire was then annealed at a temperature between 380° and 740° F. The wire was then coiled and sprayed, using a conventional wire-type flame spray gun sold by Metco, Inc., of Westbury, Long Island, as the Metco-type 10E wire flame spray gun. Spraying was effected using acetylene at a pressure of 15 pounds per square inch, oxygen at a pressure of 40 pounds per square inch, and air as a blast gas at a pressure of 50 pounds per square inch. The oxygen gas flow was maintained at 52 cubic feet per hour and the acetylene gas flow at 42 cubic feet per hour. The wire was sprayed with a spray rate of 6 pounds per hour at a spraying distance between 4 and 5 inches, with the spray material being deposited on the surface of a ground and machine-finished cold rolled steel. The sprayed coating was built up to a thickness of 0.030" and then wet-ground, using a 60 grit silicon carbide wheel. A smooth bearing surface was formed with a ground surface finish of 10 to 35 AA (arithmetic average) as measured by Model 21 Profilometer Model QC (made by Micrometrical Manufacturing Co., Ann Arbon, Mich.), using 0.030 inch cutoff in both longitudinal and transverse directions. The coating had a hardness, Rockwell, of RC 28–30, a bond strength of about 3,600 psi, and a resistance to abrasive wear equal to that achieved with sprayed molybdenum wire. The coefficient of friction measured as sliding friction against a kerosene-lubricated RC 60 hardened steel was 0.23 maximum, with an average of 0.17, as measured on an Alpha LFW-1, friction and wear testing machine sold by Fayville-Levalle Corp., Downers Grove, Illinois, using a 1.378" diameter test ring, at 100 lbs. load at 197 RPM, for 12,000 revolutions.

EXAMPLE 2

Example 1 was repeated, except that the powdered core material was formed using cobalt oxide in place of the zirconium oxide. Comparable results were obtained.

While the invention has been described in detail with reference to certain specific embodiments, various changes and modifications which fall within the spirit of the invention may become apparent to the skilled artisan. The invention, therefore, is only intended to be limited by the appended claims or their equivalents, wherein I have attempted to claim all inherent novelty.

What is claimed is:

1. In the flame spray process, the improvement which comprises flame spraying a flame spray wire comprising a sheath of aluminum and a compacted powder core containing about 10 to 90% by weight of nickel, about 10 to 90% by weight of stainless steel, about 1 to 10% aluminum, and about 1/4 to 10% metal oxide, based on the total powder compacted core, said stainless steel and metal oxide content being in sufficient quantity and proportions that when sprayed will produce a readily grindable coating.

2. Improvement according to claim 1, in which said compacted powder core contains about 5 percent by weight aluminum, 4 percent by weight zirconium oxide, about 30 percent by weight stainless steel, and the balance nickel.

3. Improvement according to claim 1, in which said nickel in said compacted powder core is present in the amount of about 61%.

4. Improvement according to claim 1, in which said stainless steel in said compacted powder core is present in the amount of about 30% by weight.

5. Improvement according to claim 1, in which said aluminum in said compacted powder core is present in the amount of about 5% by weight.

6. Improvement according to claim 1, in which said metal oxide in said compacted powder core is present in the amount of about 4% by weight.

7. Improvement according to claim 1, in which said nickel in said compacted powder core is present in the amount of about 61%, in which said stainless steel in said compacted powder core is present in the amount of about 30%, in which said aluminum in said compacted powder core is present in the amount of 5% by weight, and in which said metal oxide in said compacted powder core is present in the amount of about 4% by weight.

8. Improvement of claim 1 to 7, in which said metal oxide is zirconium oxide.

9. Improvement of claim 1 to 7, in which said metal oxide is cobalt oxide.

* * * * *